US010376737B1

(12) United States Patent
Shepherd et al.

(10) Patent No.: US 10,376,737 B1
(45) Date of Patent: Aug. 13, 2019

(54) APPARATUSES FOR TONING FACIAL MUSCLES AND PLUMPING LIPS, AND METHODS FOR USING SUCH APPARATUSES

(71) Applicants: Joanna Sarah Shepherd, Orlando, FL (US); Ruth Anne Shepherd, Orlando, FL (US)

(72) Inventors: Joanna Sarah Shepherd, Orlando, FL (US); Ruth Anne Shepherd, Orlando, FL (US)

(73) Assignee: Liptiful LLC, Fairhope, AL (US)

( * ) Notice: Subject to any disclaimer, the term of this patent is extended or adjusted under 35 U.S.C. 154(b) by 0 days.

(21) Appl. No.: 15/368,646

(22) Filed: Dec. 4, 2016

Related U.S. Application Data

(60) Provisional application No. 62/263,413, filed on Dec. 4, 2015.

(51) Int. Cl.

| | |
|---|---|
| ***A63B 23/03*** | (2006.01) |
| ***A45C 13/08*** | (2006.01) |
| ***A44C 25/00*** | (2006.01) |

(52) U.S. Cl.
CPC ..... *A63B 23/03* (2013.01); *A44C 25/00* (2013.01); *A45C 13/08* (2013.01)

(58) Field of Classification Search
None
See application file for complete search history.

(56) References Cited

U.S. PATENT DOCUMENTS

| | | | | |
|---|---|---|---|---|
| 1,983,601 | A | 12/1934 | Conn | |
| 2,189,116 | A * | 2/1940 | Niemiec | A61H 9/005 601/6 |
| 3,118,667 | A | 1/1964 | Barons | |
| 3,742,607 | A * | 7/1973 | Johnson | A61C 17/0208 433/91 |
| D403,381 | S * | 12/1998 | Hanna | D21/662 |
| 5,897,512 | A | 4/1999 | Zagame | |

(Continued)

FOREIGN PATENT DOCUMENTS

| | | |
|---|---|---|
| GB | 14989 | 6/1915 |
| GB | 169052 | 9/1921 |

OTHER PUBLICATIONS

Joejude Enterprises, Bamfaux (Imitation Bamboo) Couplings, 2008 [retrieved on Dec. 4, 2016]. Retrieved from the Internet: <URL: http://www.imitationbamboo.net/couplings.htm>.

*Primary Examiner* — Stephen R Crow
(74) *Attorney, Agent, or Firm* — Venjuris, P.C.

(57) ABSTRACT

Apparatuses for plumping and toning facial muscles, and methods for using such apparatuses, are disclosed herein. A preferred embodiment of the apparatus is configured to work as an exercise weight for facial muscles, including as a lip plumper, and comprises an outer surface, an interior hollow, and a rim between the interior hollow and the outer surface. The preferred rim comprises an interior edge transitioning to the interior hollow, an exterior edge transitioning to the outer surface, and a recessed indentation, or dip, located between the interior and exterior edges. The preferred interior hollow is configured for the user to pucker at least a portion of the user's lip(s) into the interior hollow and support the weight of the embodiment, in whole or in part, by the lip(s). The embodiment may further include a sidewall, a lanyard hole, and an air hole.

17 Claims, 4 Drawing Sheets

(56) References Cited

U.S. PATENT DOCUMENTS

| | | | | |
|---|---|---|---|---|
| 6,405,737 | B1 * | 6/2002 | Sheffler | A45D 34/06 132/297 |
| D665,038 | S * | 8/2012 | Wen | D21/662 |
| 8,376,912 | B1 * | 2/2013 | Dedvukaj | A63B 23/032 482/11 |
| 8,858,472 | B2 | 10/2014 | Gomez | |
| 9,119,758 | B2 | 9/2015 | Ho | |
| 9,855,187 | B2 * | 1/2018 | Martin | A61H 23/00 |
| 2004/0073144 | A1 * | 4/2004 | Carava | A61H 9/005 601/6 |
| 2005/0192157 | A1 * | 9/2005 | Norton | A63B 21/002 482/11 |
| 2005/0267386 | A1 * | 12/2005 | Copelan | A61H 9/005 601/14 |
| 2006/0155219 | A1 | 7/2006 | Potter | |
| 2006/0235339 | A1 | 10/2006 | Naldoni | |
| 2009/0030368 | A1 | 1/2009 | Silver | |
| 2013/0046211 | A1 * | 2/2013 | Ho | A61M 1/08 601/6 |
| 2013/0260963 | A1 * | 10/2013 | Takashi | A63B 23/032 482/11 |
| 2014/0081183 | A1 * | 3/2014 | Gomez | A61H 9/0057 601/6 |

* cited by examiner

APPARATUSES FOR TONING FACIAL MUSCLES AND PLUMPING LIPS, AND METHODS FOR USING SUCH APPARATUSES

CROSS-REFERENCE TO RELATED APPLICATION

The present application claims priority to United States provisional patent application entitled "Cosmetic Lip Enhancement Tool," having Ser. No. 62/263,413, filed on Dec. 4, 2015, which is entirely incorporated herein by reference.

BACKGROUND

For some people, the pursuit of beauty is never-ending; however, beauty standards change over time, requiring different approaches. Currently, plump lips are a popular style, and so are various methods for plumping them. Popular methods for building fuller lips range from expensive plastic surgeries and injections, to non-intrusive and inexpensive lip plumpers such as lip gloss with blood-flow boosting ingredients, and tools that require significant sucking or suction to draw body fluid to the lips. Surgeries and injections generally create plump lips that last for months, while the fuller lips achieved by their non-intrusive counterparts last only hours.

For those who want the benefits of both sides—non-intrusive, inexpensive, yet long lasting lip plumping and toning effects—facial exercises may be an answer. Various facial exercises, or face yoga, for lip plumping, are activities designed to firm the muscles around a person's mouth and increase blood flow to the lips. Increased blood flow, in turn, stimulates the production of collagen and is believed to eventually result in plumper and stronger lips. Such facial exercises may also strengthen a person's lips, mouth and jaw so that the person is better able to use these muscles in talking, chewing or other oral functions. Such facial exercises and their outcome, are especially helpful for individuals who struggle with physical aspects of producing language, including children with Down syndrome and other speech issues and delays, given that existing tools tend to be only for adults, and often teach against use by children. Such facial exercises are also helpful for individuals such as singers, or musicians who play brass instruments like trombones or tubas, or woodwind instruments like flutes or saxophones (all of which require extensive use of the mouth) to strengthen their lip, mouth and jaw muscles.

Unlike building muscles in the body for which various equipment such as dumbbells, weights, resistance bands, and so on, exists to facilitate the process, toning facial muscles generally involves only facial movements such as lip circles, closed-mouth smiles, and so forth, and therefore can take time before any effects show up. Because the lip and mouth areas contain up to dozens of individual muscles, building lip volume (i.e., a plumping) through muscle strengthening takes time and patience. Moreover, existing lip plumping tools often require a user to engage in heavy sucking, which can have a temporary plumping effect but tends to work against the muscle growth that results in more long-lasting effects. Because the lip plumping and jaw strengthening process by facial exercises is slow, not many people are persistent enough to see the results.

It is well known that in order to tone muscles, muscles must be challenged. Muscles can be challenged by repetitive motions, but if a faster result is desired, a common way to do so is to force muscles to lift or support weights more than they usually do.

Existing lip plumping tools are not configured to work as an exercise weight. Generally, these tools are configured to plump lips merely or primarily by suction and thus have a rim or surface that is pressed up against the lips and its surrounding areas. Such rims or surfaces are normally flat, raised or rounded and often encourage more sucking than is necessary, which can lead to over-plumping and irritation of the lips, swelling, bruising or other unsightly marks on the face. Such surfaces also make it more difficult to establish and hold the light suction required to most effectively exercise the facial muscles and create the effect of lip-plumping.

Therefore, it is desirous to have a non-intrusive and inexpensive tool for toning facial muscles which in turn plumps and strengthens lips, along with other facial muscles including the mouth and jaw.

It is also desirous to have a tool configured as an exercise weight for facial muscles that act on lips in order to speed up the muscle toning and lip plumping process.

Additionally, it is also desirous to have a tool configured as a lip plumper or exercise weight for facial muscles that does not cause over-plumping, irritation of the lips, swelling, bruising or other unsightly marks on the face.

SUMMARY

The structure, overall operation and technical characteristics of the present invention will become apparent with the detailed description of preferred embodiments and the illustration of the related drawings as follows.

The invention is incorporated in apparatuses for cosmetically enhancing a user's lip(s), and methods for using such apparatuses. A preferred embodiment of the apparatus is configured to work as an exercise weight for facial muscles. The preferred embodiment comprises an outer surface, an interior hollow with an opening opposite to the outer surface, and a rim bordering the opening and coupled to the outer surface. In this embodiment, the rim comprises an interior edge transitioning to the interior hollow, an exterior edge transitioning to the outer surface, and an indentation located between the interior edge and the exterior edge. Throughout this disclosure, the term "edge" generally refers to an intersection or a transitioning area between two surfaces which can be either rounded or not. For instance, the interior edge of this embodiment may be a rounded intersection between the rim and the interior hollow while the exterior edge may intersect with the outer surface at a right angle.

The outer surface of this embodiment may have one or more aesthetic elements such as colors, textures, shapes, sizes, patterns, and so forth. For instance, the outer surfaces of various embodiments may bear various designs such as hearts, strawberries, watermelons, seashells, cupcakes, ice cream cones, flowers, starfishes, lips, cylinders, dinosaurs, ladybugs and other animals, and so forth. The outer surfaces of various embodiments may also have various patterns or designs such as stripes, dots, check patterns, alligator skins, and so on.

In this embodiment, the outer surface may further comprise a lanyard hole configured for a lanyard to pass through. With the lanyard, the user may wear the embodiment as jewelry or attach the embodiment to a purse or a bag for decoration or easy access. The lanyard hole of the embodiment may be located on the top or any side of the outer surface.

Like in any muscle building exercises, holding some weight on a user's lip(s) may help to tone the corresponding facial muscles which in turn boosts collagen and plumps lips. As such, an embodiment is preferably made of somewhat weighted materials, such as clay, glass, metal, stone, plastics, resin, bamboo, and so forth. Alternatively, the embodiment may additionally comprise small weights, including marbles, fake diamonds, and/or beads.

Additionally, the interior hollow of an embodiment is preferably configured to accommodate at least a portion of the user's lip(s) when the user puckers the lips and for the user's puckered lip(s) to temporarily support at least a partial weight of the apparatus in order to develop the muscle(s) acting on the user's lip(s). Here, puckering a user's lip(s) refers to the action of gathering the muscles near the user's mouth to make the lip(s) slightly protrude, which may be achieved by blowing a small stream of air into a small area such as the interior hollow of an embodiment. The portion of the user's lips to exercise or plump may include the pout, each side of the lips, the upper lip, the lower lip, the whole lips, and so forth. The time period for a session of facial exercises with an embodiment and frequency of such exercises may vary from person to person, depending on how intense the user wants the exercises to be. For instance, a beginner may use the embodiment for two 5- to 10-second sessions per day, with or without suction, while a more experienced user may use it for one 20- to 30-second session a day.

The embodiment is preferably configured based on the size of the user's lips, the user's age, and the degree of plumping desired. For instance, if an embodiment is intended to be used by a smaller user (such as a small adult or a child) who generally has a relatively smaller facial bone structure and muscle size, the embodiment preferably has a smaller and shallower internal hollow and is overall lighter in weight.

In addition to supporting the weight of an embodiment with the user's lip(s), the user may, but does not have to, hold the embodiment in place with the help of the user's tongue, one or more fingers, and/or light suction between the embodiment and the user's face and then exercise the facial muscles with the embodiment moving along. Suction in the interior hollow of an embodiment can quickly swell lips up but may also cause burst blood vessels, bruising, and over-plumping. Therefore, even though an embodiment is intended to provide an exercise weight for facial muscles, if suction is to be used to hold the embodiment, the weight of the embodiment is preferably limited (such as no more than approximately five ounces (5 oz)) according to the desired degree of plumping, the user's age, and/or the user's lip size, so that the user only needs a slight suction to hold the embodiment. For instance, embodiments to be used by children, teenagers, or beginners are preferably lighter in weight (such as approximately one ounce (1 oz)) while experienced adults can generally use heavier embodiments.

The preferred embodiment is configured to be supported partially by light suction, and its rim is configured to seal the embodiment against the user's face when a light suction is formed inside the interior hollow. If the internal hollow of an embodiment has only one opening, the user may cause a suction which in turn makes the rim seal the embodiment against the user's face by puckering the lip(s), with the desired portion of the lip(s) protruding into the internal hollow, and drawing air from the internal hollow with the mouth.

An alternate embodiment may further include an air hole extending from the outer surface to the interior hollow. With such an embodiment, the user may apply the interior hollow of the embodiment to the user's puckered lip(s) at the desired portion to support the embodiment, in whole or in part, and keep the lip(s) puckered by blowing a small stream of air into the interior hollow during facial exercises. If a light suction is desired, the user may create the suction and seal at the rim by either (a) covering the air hole of the embodiment with a finger and drawing air from the internal hollow with his/her mouth until the seal is formed; or (b) pressing the embodiment against the user's face near the lip(s) to form a seal between the rim and the face, blowing air into the interior hollow, and then covering the air hole with a finger while simultaneously ceasing any blowing. The embodiment with an air hole is advantageous, particularly for an inexperience or young user, because if no suction is used, blowing air helps the user focus on the facial exercises with the embodiment, rather than maintaining the lip's puckering position. If a suction is applied, the suction in the interior hollow of an embodiment with an air hole created by the user is generally lower than that of the embodiment without an air hole, and thus less likely to cause bruises, marks, or over-plumping. This may be because the user has to hold this embodiment, at least with the finger covering the air hole, which reduces the weight to be supported by suction and/or because the user's finger that covers the air hole can feel the suction as well and fingers are generally more sensitive than, or at least as sensitive as, lips, which could prevent the user from creating too much suction.

Furthermore, in order to prevent bruising, marking, or over-plumping, the rim of the preferred embodiment further comprises a shallow indentation, or dip, between the rim's interior and exterior edges. The indentation of the embodiment may extend along the whole rim or be located at a partial area. For an embodiment that has an indentation on the rim that encircles the rim's interior edge, the depth and width of the indentation may vary at different areas of the rim.

Another preferred embodiment of the apparatus comprises a first surface, a second surface opposite to the first surface, an interior hollow with an opening at the second surface, and a sidewall bordering the interior hollow and forming a rim at the second surface. The rim of this embodiment comprise an interior edge, an exterior edge, and a shallow indentation, or dip, located between the interior edge and the exterior edge.

Like the preferred embodiment illustrated above, this preferred embodiment is configured to receive at least a portion of a user's lip(s), and for the user's lip(s) to temporarily support at least a partial weight of the embodiment in order to develop at least a facial muscle acting on the lip(s). This embodiment may also be configured for the rim to form a seal between the embodiment and the user's face when the user puckers a desired portion of the lip(s) into the interior hollow and causes a light suction in the interior hollow.

This preferred embodiment may additionally comprise one or more features illustrated above, such as an air hole, a lanyard hole, aesthetic elements, and so forth, while the features may be located at locations different from the aforementioned preferred embodiment. For instance, the lanyard hole or the air hole of this preferred embodiment may be located at the sidewall, not the first surface as that in the previous preferred embodiment.

The sidewall of this embodiment may attach to the first surface at various angles and have one or more aesthetic elements of its own, different from or supplementing that/those of the first surface. For instance, the sidewall of a cylindrical embodiment may be smooth and painted in red while the first surface is painted yellow and has a flower design. In another embodiment, the sidewall and the first surface may bear a 3D pink rose design together.

Moreover, an embodiment of the apparatus may further comprise elements such as a knob at the outer/first surface or the sidewall, if any, configured for the user to hold the embodiment. In such an embodiment, the knob may further accommodate the lanyard hole or air hole or form a portion of the aesthetic elements of the outer/first surface and/or sidewall.

An alternate preferred embodiment of the apparatus may include an outer surface, an interior hollow, and a substantially planar, or flat, rim bordering the interior hollow. The interior hollow of this embodiment opens at a direction opposite to the outer surface and may accommodate at least one portion of the user's lip(s) when the lip(s) is/are puckered. This preferred embodiment has a weight between 0.5 oz and 4.5 oz so that temporarily supporting such weight, in whole or in part, by the user's puckered lip(s) inside the interior hollow would help to develop the facial muscle(s) acting on the user's lip(s) as illustrated above.

The rim of this preferred embodiment may further comprises a shallow indentation located between the rim's interior and exterior edges. Since this rim is substantially planar, the variation among the heights of its shallow indentation, interior edge, and exterior edge is no more than 4 mm, preferably less than 2 mm. This exemplary rim may be configured to form a seal between the apparatus and a user's face when the at least one portion of the user's lip(s) is/are puckered inside the interior hollow and a suction is created by the user. Also, this embodiment may further have an air hole extending from the outer surface to the interior hollow, a lanyard hole configured for a lanyard to pass through, various aesthetic elements on the outer surface, and/or other features of the embodiments above.

As to how to use an embodiment of the apparatus (hereinafter the tool) for enhancing a user's lip(s) or facial muscles by suction without bruising or marking, a preferred embodiment of the method may comprise the steps of:

(a) applying the tool against a user's face, the tool having at least one or more of the features in the aforementioned embodiments;
(b) creating a seal between the user's face, near the at least one portion of the lip(s), and the tool at its rim which borders the tool's interior hollow and has an indentation or dip, preferably shallow, between the rim's interior and exterior edges;
(c) applying suction to the at least one portion of the lip(s); and
(d) temporarily supporting at least a partial weight of the tool by suction and the user's lip(s).

In this preferred embodiment of the method, the suction may be created by drawing air from the tool's interior hollow into the user's mouth until the seal is formed. Alternatively, if the tool used has an air hole, the suction may be created by either (A) creating a seal between the tool and the user's face, blowing air from the user's mouth into the tool's interior hollow, and then covering the tool's air hole and simultaneously ceasing to blow; or (B) covering the tool's air hole, and then drawing air from the interior hollow into the user's mouth until the seal is formed.

One object is to provide apparatuses and methods for building muscles around the mouth and jaw including the user's lips, causing collagen production and circulation in the lips in order to plump, tone and shape the user's lips.

Another object is to provide non-intrusive, inexpensive apparatuses and methods for creating long lasting lip-plumping effects.

Another object is to provide non-intrusive, inexpensive apparatuses and methods for exercising and building the muscles of the lips and/or other facial muscles including the mouth and jaw for various purposes, including but not limited to assisting individuals including children, who have weaker lip and jaw muscles, and assisting musicians and others who require strong lip and mouth muscles, to build up these muscles so that they are better able to use them in talking, chewing, playing musical instruments, or other oral functions.

BRIEF DESCRIPTION OF THE DRAWINGS OR PICTURES

DESCRIPTION OF THE EMBODIMENTS

Figure 1A:
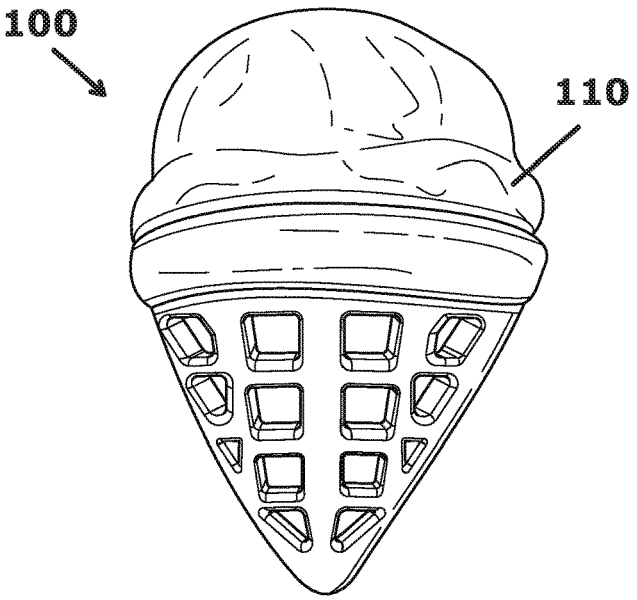
FIG. 1A is a top plan view of an ice-cream-cone-shape embodiment of the lip enhancing apparatus.

Exemplary embodiments of the apparatus for cosmetically enhancing a user's lip(s) are shown in FIGS. 1-4. An embodiment 100 shown in FIGS. 1A-1B comprises an outer surface 110 bearing an ice-cream-cone design, an interior hollow 120 that opens at a direction (opening 121) opposite to the outer surface 110 and a bottom 122 opposite to the opening 121, and a rim 130 bordering the opening 121 with its interior edge 131 and transitioning to the outer surface 110 with its exterior edge 132. Between the interior edge 131 and exterior edge 132 lies an indentation or dip 133 that encircles the interior edge 131 and the interior hollow 120.

The interior hollow 120 is preferably configured to accommodate at least a portion of a user's lip(s) when user puckers the lip(s) and for the user's puckered lip(s) to temporarily support the weight of the embodiment 100, in whole or in part, in order to develop the muscles acting on the user's lip(s). With the lip(s) supporting the embodiment 100, the user may then hold the embodiment 100 for a certain period of time or exercise his/her facial muscles with the embodiment 100 moving along with the lip(s) as an exercise weight. The interior hollow 120 of this embodiment 100 has approximately a ¾" depth and a circular opening 121 with approximately a one inch (1") diameter and is suitable for an adult with medium sized lips. Other embodiments include smaller and larger sizes that can be used by adults with larger lips, by teenagers or young children, or on a single lip or a portion of one or both lips.

Additionally, the rim 130 of this embodiment 100 is configured to form a seal between a user's face and the embodiment 100 when a suction is created at the interior hollow 120. If a suction is needed to support the embodiment 100, a user may create the suction by: (A) placing the embodiment 100 against his/her face with the embodiment 100 covering a portion of the user's mouth including the desired portion of the lips, such as the pout of the upper lip or the whole upper and lower lips, (B) puckering the lip(s) so that the desired portion of the lip(s) contacts the interior hollow's wall 123 and supports, in whole or in part, the weight of the embodiment 100, and (C) drawing air from the interior hollow 120 to the mouth. The user may choose how strong the suction is by drawing less air for a lighter suction and more air for a greater suction. The embodiment 100 is preferably properly weighed so that the user does not need a strong suction to hold the embodiment 100.

Furthermore, the embodiment 100 is preferably made out of clay and has a height of approximately 1" measured from the highest point of the outer surface 110 to the rim 130. This embodiment 100 weighs approximately 2.5 oz. and can generally be held by the user's lip(s) and a slight suction alone. Alternatively, the user may hold the embodiment 100 with the help of the user's tongue and finger(s), without any suction. A person skilled in the art would know how to adjust the dimensions, materials, and weight of an embodiment based on the size of the intended user and his/her lips, and the degree of lip plumping needed.

Figure 2A:
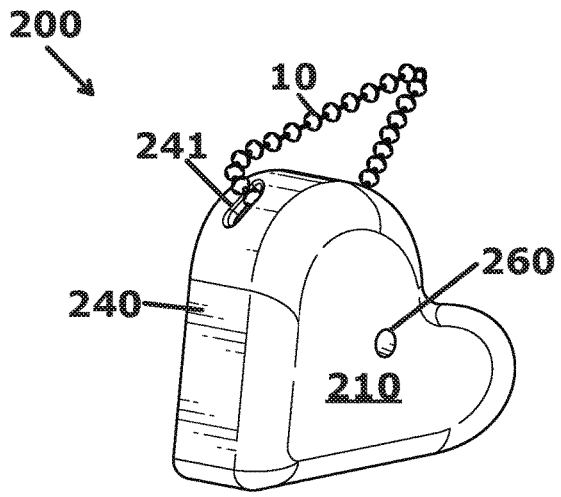
FIG. 2A is a perspective view of a heart-shape embodiment of the lip enhancing apparatus.
Figure 2B:
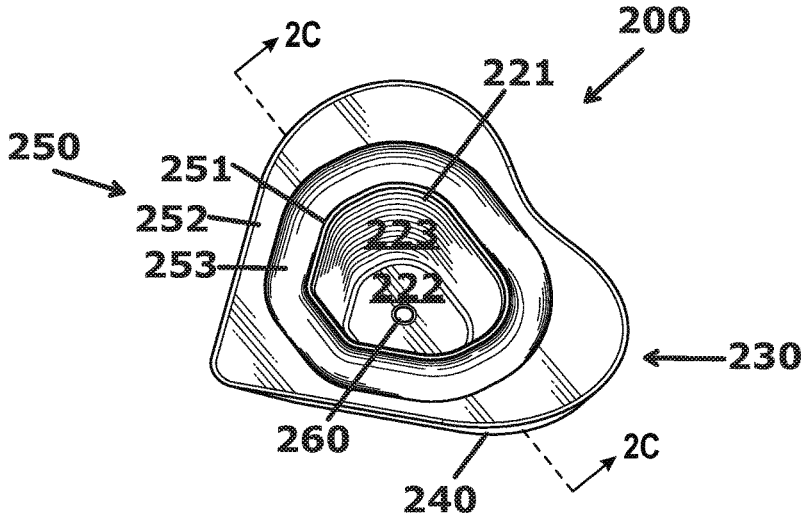
FIG. 2B is a perspective view of the embodiment in FIG. 2A.
Figure 2C:
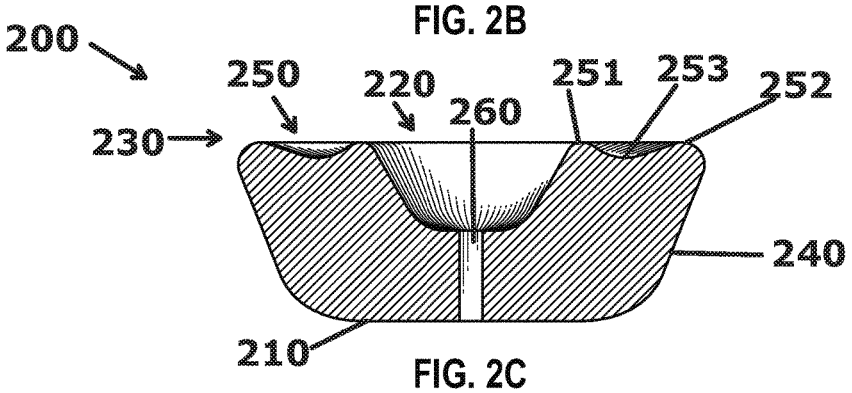
FIG. 2C is a cross sectional view of the in FIG. 2B, along the virtual line 2C-2C.

FIGS. 2A-2C show an alternate preferred embodiment 200. The embodiment 200 comprises a heart-shaped first surface 210, a second surface 230 opposite to the first surface 210, an interior hollow 220 that opens at the second surface 230 (the opening 221) and a bottom 222 opposing the opening 221, and a sidewall 240 coupled to the first surface 210, bordering the interior hollow 220, and forming a rim 250 at the second surface 230. The rim 250 has an interior edge 251 bordering and transitioning to the interior hollow 220, an exterior edge 252 transitioning to the sidewall 240, and an indentation or dip 253 between the interior and exterior edges 251 & 252.

The indentation or dip 253 of this embodiment 200 surrounds the interior edge 251 and interior hollow 220. As shown in FIG. 2C, the indentation or dip 253 of this embodiment 200 is shallow and the rim 250 is substantially planar. This embodiment 200 can additionally comprise a lanyard hole 241 at the sidewall 240 and configured for a lanyard 10 to pass through. This embodiment 200 can further comprise an air hole 260 extending from the outer surface 210 to the bottom 222.

Figure 1B:
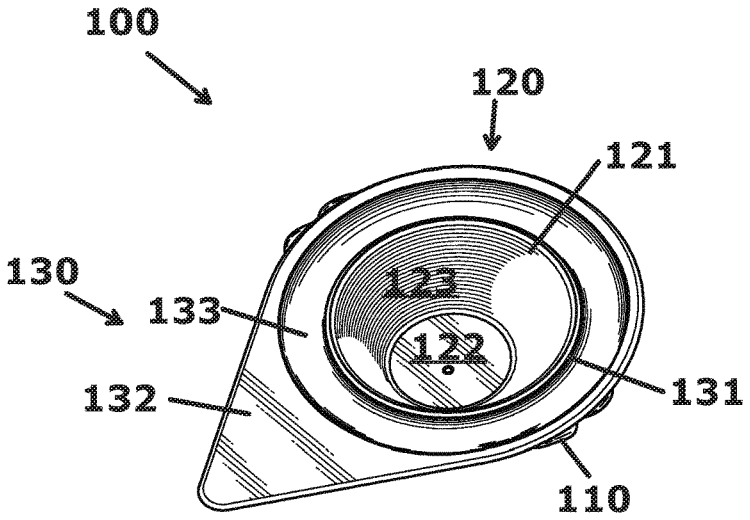
FIG. 1B is a perspective view of the embodiment in FIG. 1A.

As in the embodiment 100 in FIGS. 1A-1B, the rim 250 of this embodiment 200 is configured to form a seal between a user's face and the embodiment 200 when the air hole 260 is covered and a light suction is created at the interior hollow 220. The suction can be created by the user placing the embodiment 200 against his/her face with the embodiment 200 covering a portion of the user's mouth including the desired portion of the lips, puckering the lip(s), covering the air hole 260 with a finger, and then drawing air from the interior hollow 220 to the mouth. Alternatively, the user may place the embodiment 200 against his/her face with the embodiment 200 to form a seal between the face and the rim 250, covering a portion of the user's mouth as illustrate above, blow air to the interior hollow 220, and then cover the air hole 260 with a finger and stops blowing. The suction created by the latter method is generally lower and gentler to the user's lips.

Figure 3A:
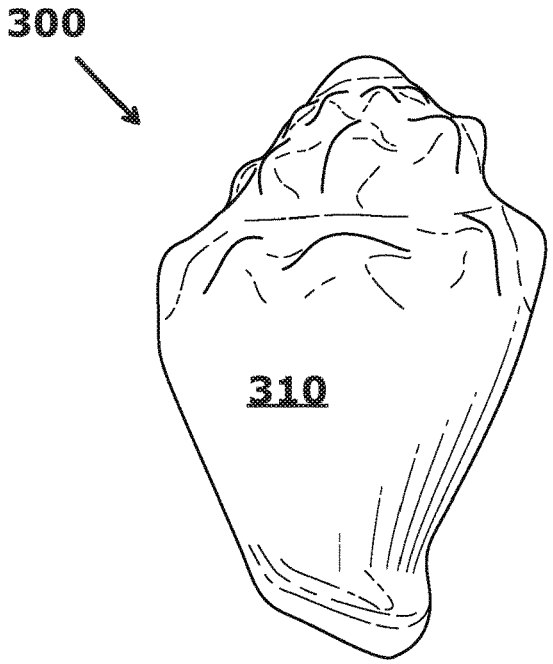
FIG. 3A is the top plan view of a conch-shell-shaped embodiment of the lip enhancing apparatus.
Figure 3B:
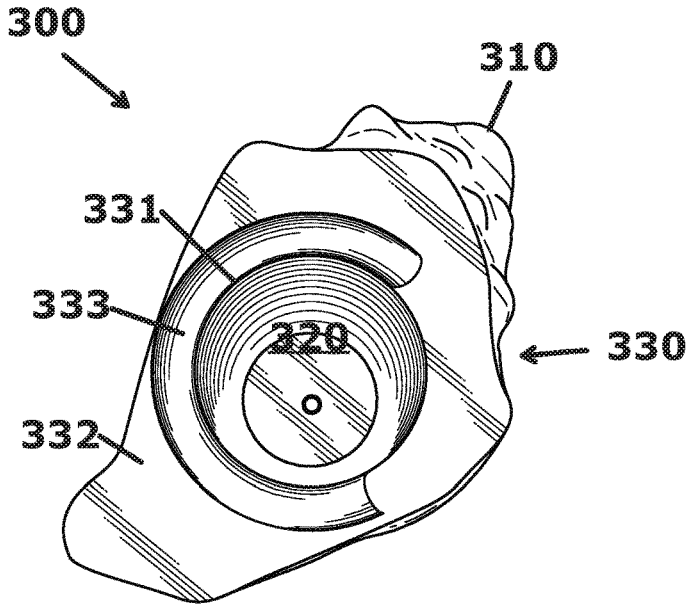
FIG. 3B is a perspective view of the embodiment in FIG. 3A.

An alternate embodiment 300 in FIGS. 3A-3B has an outer surface 310 bearing an ornamental shell design. In this embodiment 300, the interior hollow 320 is circular and wider than those in the embodiments in FIGS. 1-2 and may be used for users with bigger lips. The indentation or dip 333 extends around only a portion of the rim 330 between the interior edge 331 and the exterior edge 332, rather than encircling the whole interior edge 331.

Figure 4A:
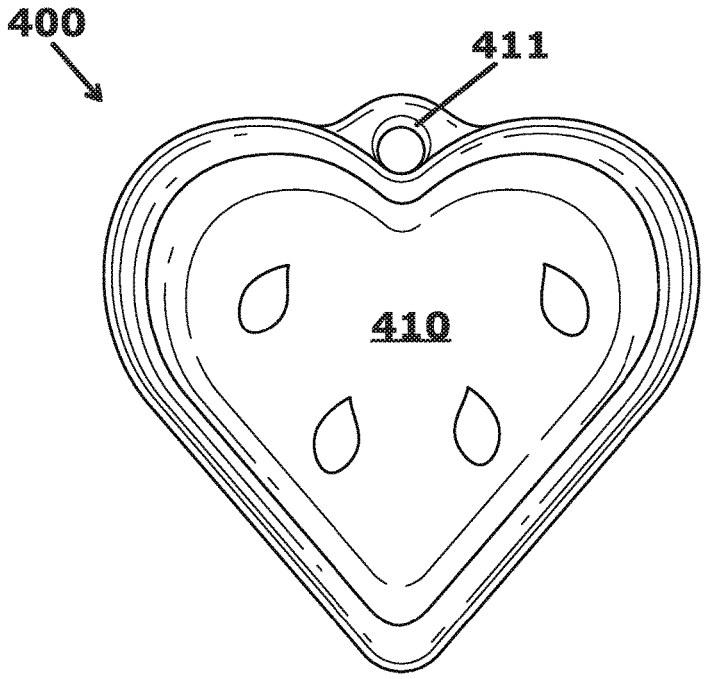
FIG. 4A is the top plan view of an alternate heart-shaped embodiment of the lip enhancing apparatus.
Figure 4B:
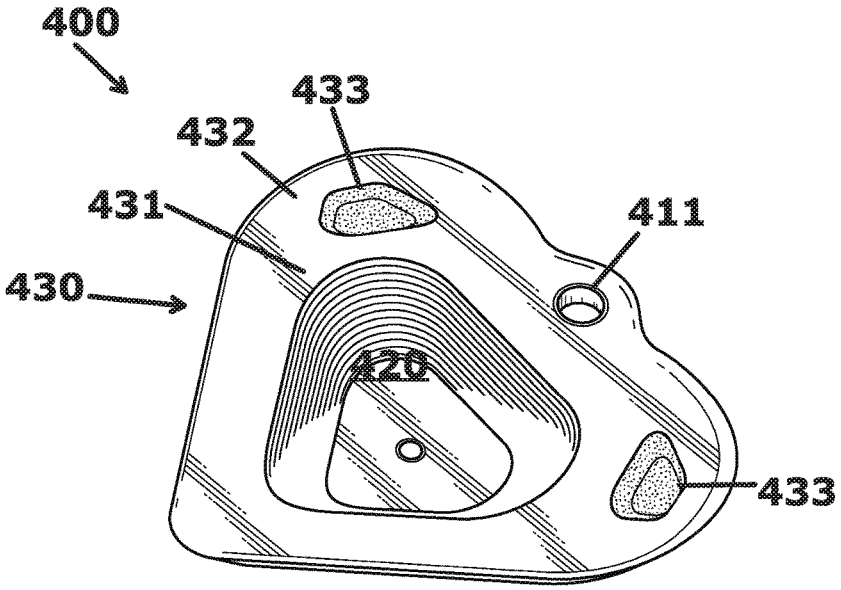
FIG. 4B is a perspective view of the embodiment in FIG. 4A.

Another embodiment 400 in FIGS. 4A and 4B has an outer surface 410 that bears an ornamental heart shape with watermelon seed or drop designs. In this embodiment 400, the outer surface 410 further comprises a lanyard hole 411 at the top that goes all the way to the rim 430. This embodiment 400 is configured to be used by children or teenagers and has a small and shallow interior hollow 420. The rim 430 between the interior edge 431 and the exterior edge 432, has two shallow indentations, or dips, 433 at its wider portions, with the remainder of the rim 430 on substantially the same plane.

While the invention has been described by means of specific embodiments, numerous modifications and variations could be made thereto by those ordinarily skilled in the art without departing from the scope and spirit disclosed herein. For instance, an embodiment may be of various shapes, sizes, and/or materials. The outer surface of an embodiment may bear various aesthetic elements such as different colors, dimensions, designs, materials, and so forth. An embodiment may have an interior hollow with a depth between approximately 0.5" and 1". For an embodiment whose interior hollow has a circular opening, the opening may have a diameter between approximately ¾" and 2". Another embodiment may have an oval-shaped interior hollow that has a first width of approximately 1" and a second width of approximately 3". Various embodiments may have weights in the range of 0.5 oz (for children or beginners) to 4.5 oz (for big adults or very experienced users). Therefore, the invention is intended to cover all techniques, devices, or structures known in the art and not be limited in scope except by the purview of the appended claims.

The invention claimed is:

1. An apparatus for plumping or toning one or more facial muscles of a user, the apparatus comprising:

a. an outer surface;

b. an interior hollow that opens at a direction opposite to the outer surface and is configured to accommodate at least one portion of at least a lip of the user when the lip is puckered; and c. a rim bordering the interior hollow, the rim comprising:

i. an interior edge adjacent to the interior hollow, ii. an exterior edge adjacent to the outer surface, and iii. an indentation located between the interior edge and the exterior edge; said rim indention extends along the whole interior edge.

2. The apparatus in claim 1 further comprises an air hole extending from the outer surface to the interior hollow.

3. The apparatus in claim 1, wherein the outer surface further comprises a lanyard hole configured for a lanyard to pass through.

4. The apparatus in claim 1, wherein the interior hollow is further configured for the user's puckered lip to temporarily support at least a partial weight of the apparatus in order to develop the one or more facial muscles acting on the user's lip.

5. The apparatus in claim 1, wherein the rim is further configured to form a seal between the apparatus and a user's face when the at least one portion of the user's lip is puckered inside the interior hollow and a suction is created by the user.

6. An apparatus for pumping or toning one or more facial muscles of a user, the apparatus comprising:

a. A first surface;

b. A second surface opposite to the first surface;

c. An interior hollow that opens at the second surface; and d. A sidewall bordering the interior hollow and forming a rim around the second surface, the rim comprising:

i. An interior edge transitioning to the interior hollow, ii. An exterior edge, and iii. An indentation located between the interior edge and the exterior edge, wherein the interior hollow may accommodate at least one portion of at least a lip of the user when the lip is puckered; said rim indention extends along the whole interior edge has been inserted after "puckered".

7. The apparatus in claim 6 further comprises an air hole extending from the first surface to the interior hollow.

8. The apparatus in claim 6, wherein the sidewall further comprises a lanyard hole configured for a lanyard to pass through.

9. The apparatus in claim 6, wherein the first surface further comprises one or more aesthetic elements selected from a group comprising a color, a texture, a shape, a size, a pattern, and combinations thereof.

10. The apparatus in claim 6, wherein the interior hollow is further configured for the user's puckered lip to temporarily support at least a partial weight of the apparatus in order to develop the one or more facial muscles acting on the user's lip.

11. The apparatus in claim 6, wherein the rim is further configured to form a seal between the apparatus and a user's face when the at least one portion of the user's lip is puckered inside the interior hollow and a suction is created by the user.

12. An apparatus for plumping or toning one or more facial muscles of a user, the apparatus comprising:

a. an outer surface;

b. an interior hollow that opens at a direction opposite to the outer surface;

c. a rim bordering the interior hollow, the rim being substantially planar; and d. a weight in a range of 0.5 oz to 4.5 oz, wherein the interior hollow may accommodate at least one portion of at least a lip of the user when the lip is puckered; said rim further comprises a shallow indentation located between an interior edge of the rim transitioning to the interior hollow and an exterior edge of the rim transitioning to the outer surface.

13. The apparatus in claim 12, wherein a height variation among the interior edge, the exterior edge, and the indentation is no more than 2 mm.

14. The apparatus in claim 12 further comprises an air hole extending from the outer surface to the interior hollow.

15. The apparatus in claim 12, wherein the outer surface further comprises a lanyard hole configured for a lanyard to pass through.

16. The apparatus in claim 12, wherein the interior hollow is further configured for the user's puckered lip to temporarily support at least a partial weight of the apparatus in order to develop the one or more facial muscles acting on the user's lip.

17. The apparatus in claim 12, wherein the rim is further configured to form a seal between the apparatus and a user's face when the at least one portion of the user's lip is puckered inside the interior hollow and a suction is created by the user.

* * * * *